US008443700B2

(12) United States Patent
Feigel, Jr.

(10) Patent No.: US 8,443,700 B2
(45) Date of Patent: May 21, 2013

(54) TONG ASSEMBLIES

(75) Inventor: Kurt R. Feigel, Jr., Edmonton (CA)

(73) Assignee: Universe Machine Corporation, Edmonton (CA)

( * ) Notice: Subject to any disclaimer, the term of this patent is extended or adjusted under 35 U.S.C. 154(b) by 225 days.

(21) Appl. No.: 13/155,220

(22) Filed: Jun. 7, 2011

(65) Prior Publication Data

US 2012/0312128 A1 Dec. 13, 2012

(51) Int. Cl.
*E21B 19/16* (2006.01)
*B25B 13/50* (2006.01)

(52) U.S. Cl.
USPC ..... 81/57.32; 81/57.35; 81/57.15

(58) Field of Classification Search
USPC ..... 81/57.32, 57.33, 57.34, 57.35, 57.15, 81/57.16, 57.2; 166/377, 378, 380, 77.1, 166/77.51, 77.53
See application file for complete search history.

(56) References Cited

U.S. PATENT DOCUMENTS

| | | | | |
|---|---|---|---|---|
| 4,163,401 | A | 8/1979 | Sheldon et al. | |
| 4,187,546 | A | 2/1980 | Heffernan et al. | |
| 4,869,137 | A | 9/1989 | Slator | |
| 5,144,868 | A | 9/1992 | Feigel, Jr. | |
| 5,566,769 | A | 10/1996 | Stuart | |
| 6,263,763 | B1 | 7/2001 | Feigel et al. | |
| 6,386,284 | B1 | 5/2002 | Buck et al. | |
| 6,966,385 | B2 | 11/2005 | Hemphill et al. | |
| 7,000,503 | B2 | 2/2006 | Dagenais et al. | |
| 7,921,750 | B2 * | 4/2011 | Pietras | 81/57.16 |
| 2007/0079671 | A1 * | 4/2007 | Halse | 81/57.16 |

FOREIGN PATENT DOCUMENTS

| | | |
|---|---|---|
| CA | 2016319 | 11/1991 |
| CA | 2269393 | 10/2000 |

* cited by examiner

*Primary Examiner* — David B Thomas

(74) *Attorney, Agent, or Firm* — Anthony R. Lambert

(57) ABSTRACT

A tong assembly is disclosed, comprising: a frame having at least a pair of posts spaced laterally from each other to receive a tong between the posts, each post extending vertically and having a lateral stabilizing surface on a side facing inward or outward; and a tong stabilized in relation to the frame by the lateral stabilizing surfaces and by each post being received by respective openings in the tong that have a cross lateral dimension sufficient to permit cross lateral movement of the tong in relation to the frame by at least one half of the cross lateral length of the lateral stabilizing surface.

19 Claims, 8 Drawing Sheets

10
44
16
24
18
46
20, 22
11
28
30
32
31
34, 33
36
26
43
42
40

TONG ASSEMBLIES

TECHNICAL FIELD

This document relates to tong assemblies.

BACKGROUND

Power tongs are used in well drilling to rotate a tubular section that is being threaded to or unthreaded from another tubular section. Simultaneously, a backup tong may be used to hold the other tubular section stationary. Tongs may be mounted in a frame or suspended from a rig.

SUMMARY

A tong assembly is disclosed, comprising: a frame having at least a pair of posts spaced laterally from each other to receive a tong between the posts, each post extending vertically and having a lateral stabilizing surface on a side facing inward or outward; and a tong stabilized in relation to the frame by the lateral stabilizing surfaces and by each post being received by respective openings in the tong that have a cross lateral dimension sufficient to permit cross lateral movement of the tong in relation to the frame by at least one half of the cross lateral length of the lateral stabilizing surface.

Another tong assembly is disclosed, comprising: a frame having at least a horizontally extending support surface defined by one or more frame elements, the one or more frame elements including tapered seats that widen vertically; a tong mounted on the frame and secured to the frame by respective threaded pins that are secured to the tong and extend through the horizontally extending support surface and through respective ones of the tapered seats; and a lug, such as a lug nut, on each threaded pin, each lug having a taper matching the taper of the corresponding tapered seat to seat the threaded pin centered in the tapered seat when the lug is tightened.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which:

FIG. 2A illustrates the posts in a neutral position, with FIG. 2B illustrating with dashed lines a range of cross lateral motion possible.

FIG. 3A illustrates the posts in a neutral position, with FIG. 3B illustrating with dashed lines the relatively lesser range of cross lateral motion possible compared to the system of FIGS. 2A-B.

FIG. 9 illustrates the posts in a neutral position.

DETAILED DESCRIPTION

Immaterial modifications may be made to the embodiments described here without departing from what is covered by the claims.

Figure 1:
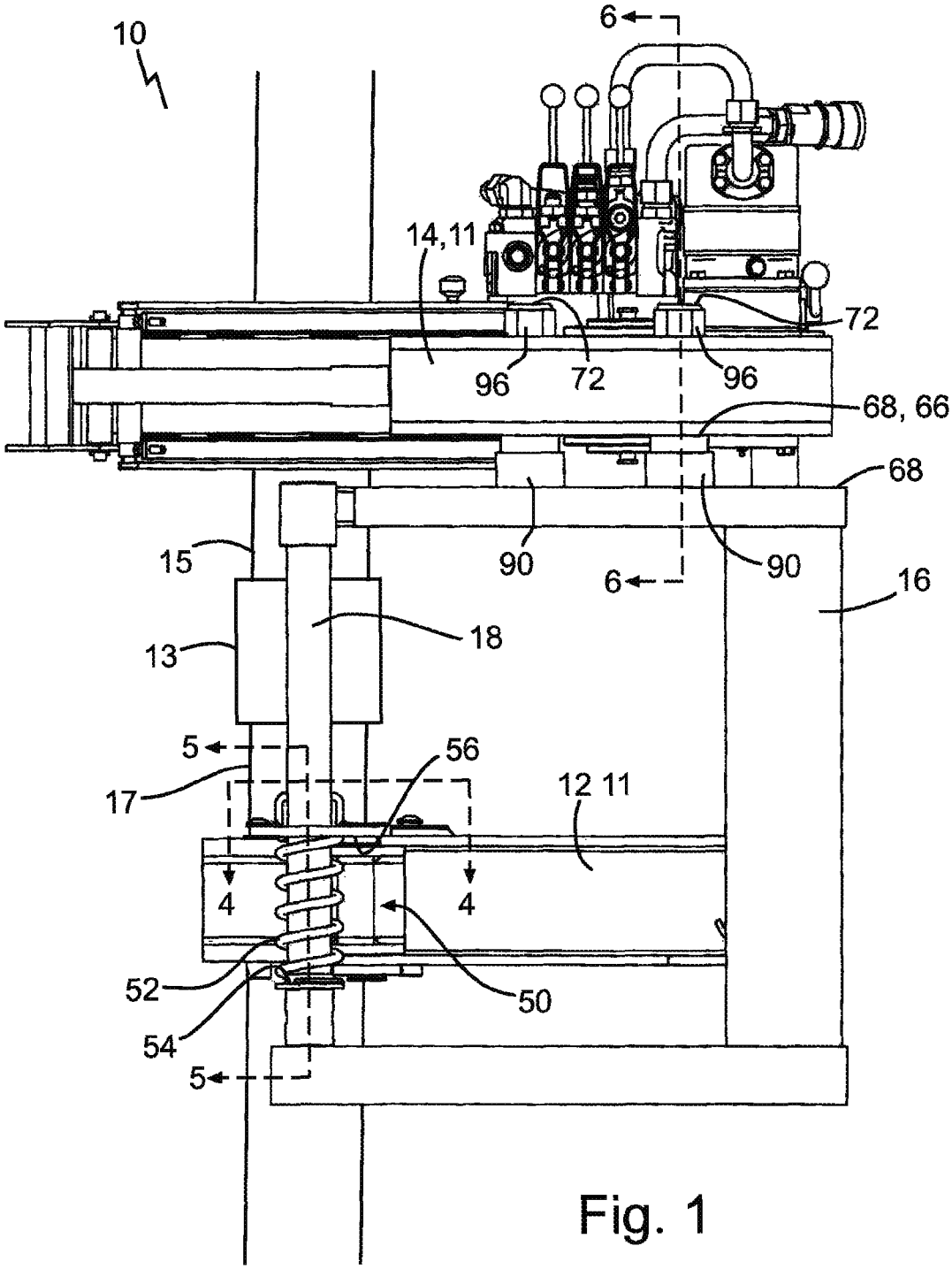
FIG. 1 is a side elevation view of a tong assembly with a backup tong and a power tong.

FIG. 1 illustrates a tong assembly 10, including a frame 16 and one or more tongs 11, for example a backup tong 12 and a power tong 14. Tongs 11 may be used to make up or break out threaded connections or joints 13 between tubulars 15 and 17. The general operation of tongs is well known and need not be described here in detail. During use, vibration and oscillation may cause wear and stress on tong 11, which may in turn cause wear and stress on tubulars 15 and 17. Vibration and oscillation may be experienced by tong 11 regardless of whether tong 11 is a backup or power tong 12 or 14.

Figures 2A, 2B, 3A, 3B:
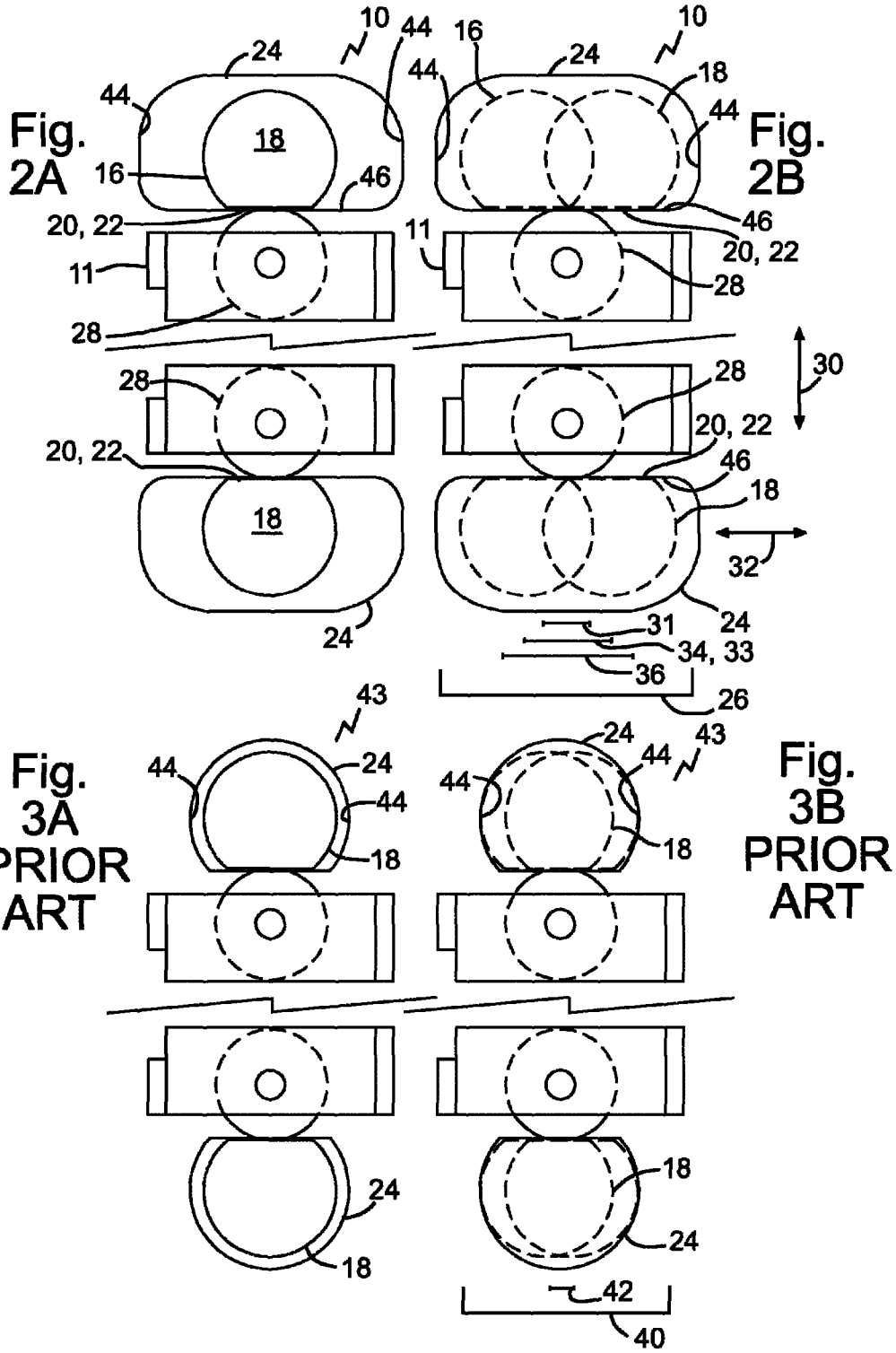
Fig. 3A PRIOR ART
Fig. 3B PRIOR ART
FIGS. 2A-B are top plan section views of a system, incorporated in the tong assembly of FIG. 1, for laterally stabilizing a tong, including a pair of frame posts received in respective openings in the tong. In use the tong is positioned in between the guide rollers.
FIGS. 3A-B are top plan section views of a known system for laterally stabilizing a tong, including a pair of frame posts received in respective openings in the tong, the system being manufactured by Universe Machine of Edmonton, Canada.

Referring to FIGS. 1, 2A-B, and 5, frame 16 may include at least a pair of posts 18 (only one shown in FIG. 1) spaced laterally from each other to receive a tong 11 between the posts 18. Referring to FIGS. 2A-B, each post 18 extends vertically and has a lateral stabilizing surface 20, such as a planar surface as shown, on a side 22 facing inward. As shown, post 18 may have a cross sectional shape of a truncated circle (shown) or truncated ellipse (not shown) to define the lateral stabilizing surfaces 20 in each post 18. Tong 11 may be stabilized in relation to the frame 16 by the lateral stabilizing surfaces 20, for example by positioning a pair of guide rollers 28 between the lateral stabilizing surfaces 20. Each guide roller 28 may be in opposing contact with a respective post 18 as shown, to rigidly hold tong 11 in place to prevent movement of tong 11 in a lateral direction 30.

Tong 11 may also be stabilized in relation to the frame 16 by each post 18 being received by respective openings 24 in the tong 11. Each opening 24 may have a cross lateral dimension 26 sufficient to permit cross lateral movement, in cross lateral direction 32, of the tong 11 in relation to the frame 16. Limiting the permitted travel of tong 11 to only cross lateral movement in the direction 32 has the advantage of reducing radial loading and axial twist placed on the joint 13 during use. Such loading and twisting is undesirable in that it causes energy loss in the form of friction, and may result in cross threading damage to joint 13. In addition, allowing some cross lateral motion allows the strain of vibration or oscillational energy to be safely released into motion, reducing wear on tong and tubular components. Cross lateral direction 32 is understood to be perpendicular to lateral direction 30. Limiting travel to cross lateral movement also reduces wear in non-lubricated areas of tong 11.

As shown, cross lateral dimension 26 may be sufficient to permit cross lateral movement of the tong 11 in relation to the frame 16 by at least one half 31, for example the entire length 33, of the cross lateral length 34 of the lateral stabilizing surface 20. Dashed lines are used to indicate a range of cross lateral positions available for post 18, although posts 18 are allowed further travel, such as in the amount 36, in the embodiment shown. Referring to FIGS. 3A-B, a prior system 43 for laterally stabilizing a tong 11 used openings 24, for posts 18, that were made with cross lateral dimensions 40 sufficient only to allow relatively smaller permitted lengths 42 of cross lateral motion.

Referring to FIGS. 2A-B, extending the relative cross lateral dimension 26 of openings 24 is advantageous in that it allows a relatively greater degree of cross lateral motion, whilst also reducing the likelihood of tong 11 receiving a jarring blow as post 18 collides with a respective cross lateral end 44 of opening 24. By contrast, prior systems like the one shown in FIGS. 3A-B allows only relatively limited cross lateral movement, for example vibration, and may result in jarring blows to tong 11 and hence tubulars 15, 17 upon collision between posts 18 and cross lateral ends 44 of openings 24. The system shown in FIGS. 2A-B thus provides an unexpected result as the resulting tong arrangement 10 may have a longer life span relative to the system shown in FIGS. 3A-B, despite being relatively destabilized by permitting additional cross lateral movement of tong 11 and hence increasing the potential for additional radial loading being placed on joint 13 during use.

Referring to FIGS. 2A-B, in some embodiments cross lateral dimension 26 may be sized large enough as shown to allow posts 18 to fall out of contact with guide rollers 28 at the cross lateral extremes (not shown) of permitted cross lateral motion. In such cases, inner surfaces 46 of respective openings 24 may act as bearing surfaces for posts 18 to slide cross laterally across. In general, although guide rollers 28 are shown as the primary bearing surfaces for contact with lateral stabilizing surfaces 20, other suitable bearing surfaces, such as a smooth metal surfaces may be used to contact surfaces 20. For the purpose of maintaining guide rollers 28 as the primary contact with lateral stabilizing surfaces 20 instead of inner surfaces 46 of respective openings 24, inner surfaces 46 may be spaced further from lateral stabilizing surfaces 20 than guide rollers 28 when guide rollers are when posts 18 are in the neutral position.

Figure 4:
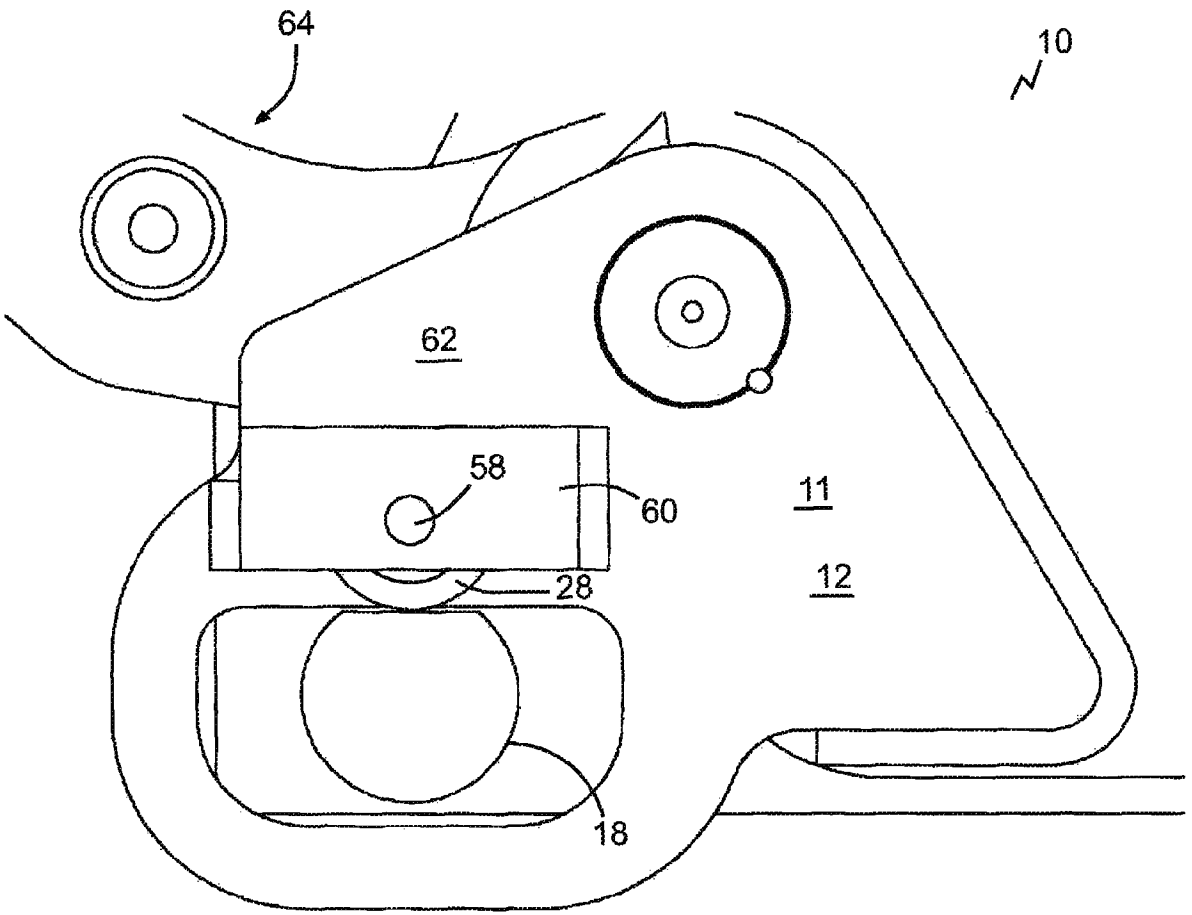
FIG. 4 is a section view taken along the 4-4 section lines of FIG. 1.
Figure 5:
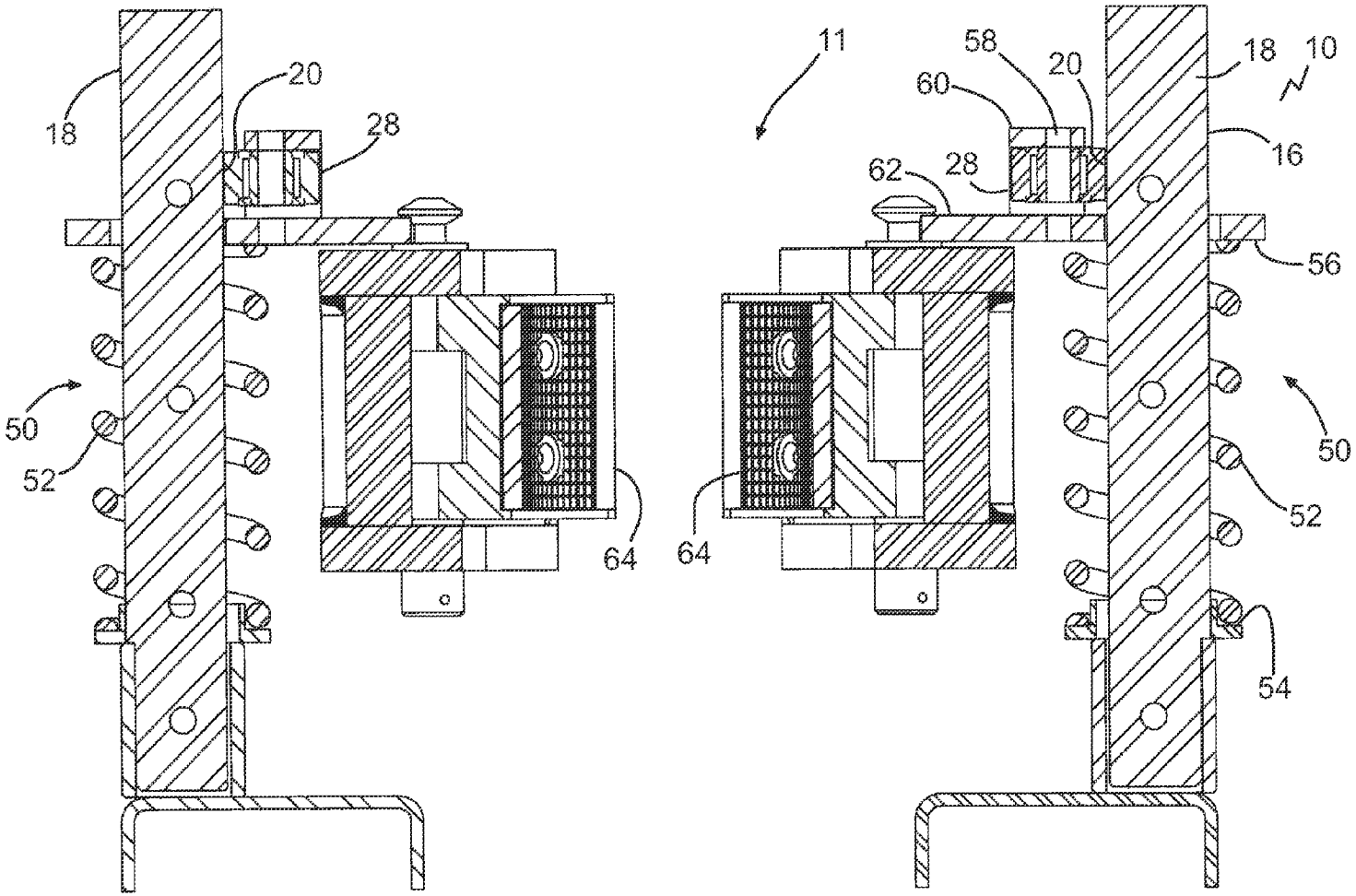
FIG. 5 is a section view taken along the 5-5 section lines of FIG. 1.

Referring to FIGS. 1 and 5, posts 18 may form suspension struts 50 for the tong 11. Struts 50 may include springs 52 held between a lower stop 54 on the frame 16 and an upper stop 56 on the tong 11 to support the vertical load of tong 11 during use. Tong 11 may be a backup tong 12 located above or, in this case, below, the power tong 14. Referring to FIGS. 4 and 5, guide rollers 28 may be mounted with locking pins 58 passed axially though respective roller frames 60 mounted on a cage plate 62 extending from tong 11. Tong 11, which may be a backup tong 12 as shown, may incorporate gripper pads 64 as shown.

Figure 9:
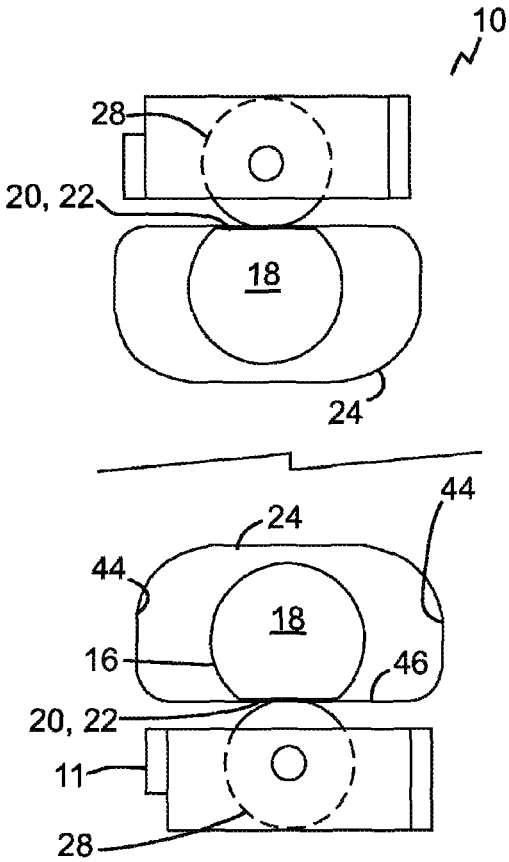
FIG. 9 is a top plan section view of a system, incorporated in a tong assembly for laterally stabilizing a tong, including a pair of frame posts received in respective openings in the tong. In this embodiment, the lateral stabilizing surfaces of the posts face outwards.

In the embodiment illustrated in FIGS. 2A-B, each lateral stabilizing surface 20 faces inwardly. Referring to FIG. 9, this orientation may be reversed, so that each lateral stabilizing surface 20 faces outwardly as shown.

Figure 6:
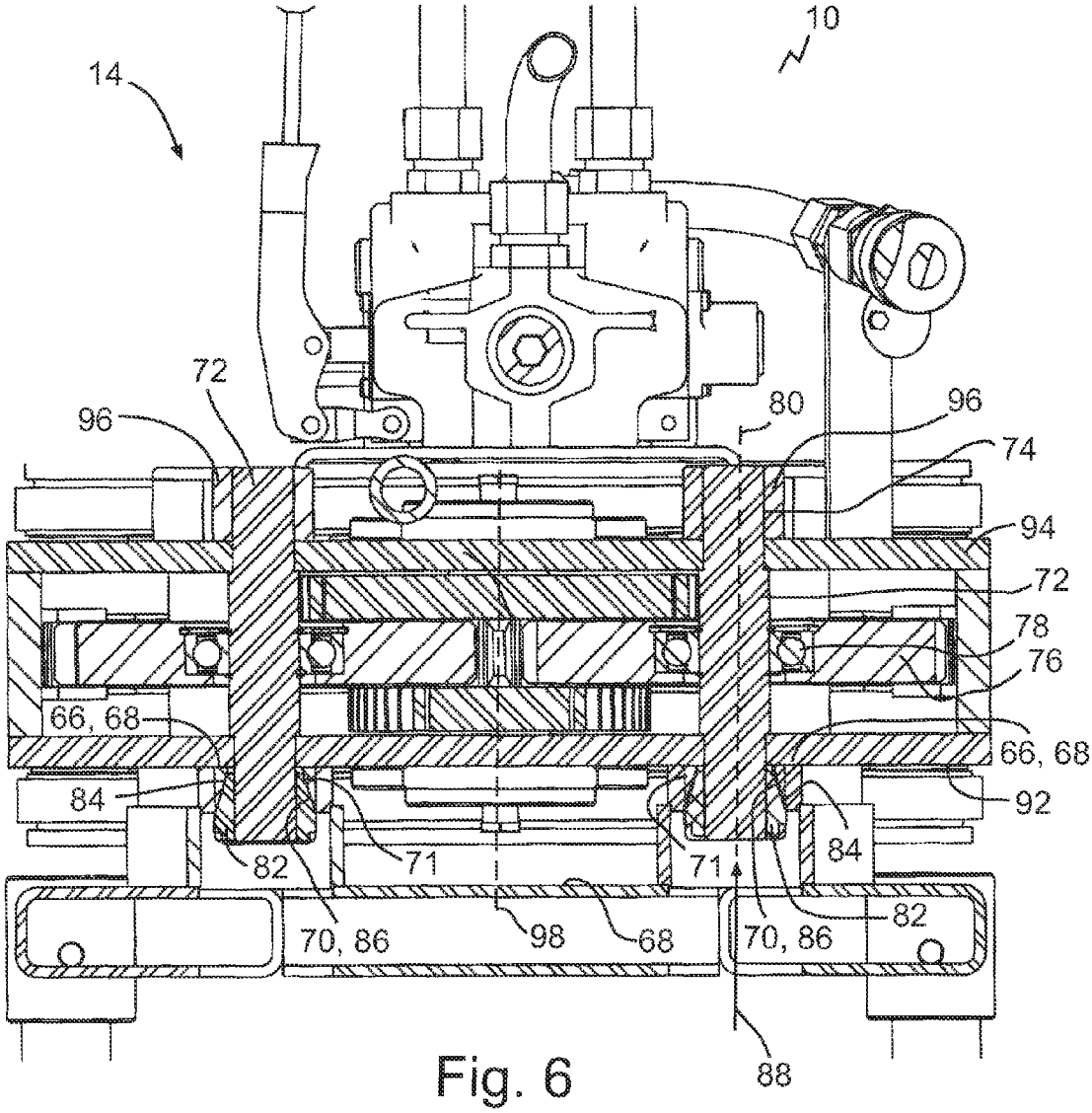
FIG. 6 is a section view taken along the 6-6 section lines of FIG. 1.

Referring to FIGS. 1 and 6, frame 16 may have at least a horizontally extending support surface 66 defined by one or more frame elements 68. As shown, some of the frame elements 68 include tapered seats 70 that widen vertically (FIG. 6). Tong 11 may be mounted on the frame 16 and secured to the frame 16 by respective threaded pins 72, which extend through the horizontally extending support surface 66 and through respective ones of the tapered seats 70. Pins 72 are also secured to the tong 11, for example if the pin 72 is part of a rod 74 for mounting an internal tong gear 76 and bearings 78. In the example shown rod 74 is an idler gear shaft. Thus, in the embodiment shown the threaded pin 72 defines an axis 80 of rotation of a component, in this case tong gear 76, within the tong 11, although rod 74 itself does not rotate in use.

A lug, such as a lug nut 82 may be on each threaded pin 72, each lug having a taper 84 matching the taper 86 of the corresponding tapered seat 70 to seat the threaded pin 72 centered in the tapered seat 70 when the lug is tightened. Although tapers 84 and 86 are described as matching, these tapers do not need to have equivalent taper angles or profiles. Lugs operate in a fashion similar to lug bolts or nuts used to secure a wheel to a car. Lugs are advantageous for the purpose of securely and reliably mounting tong 11 in place on frame 16 because lugs reduce or prevent loosening, which may occur with regular nut/bolt connections due to fretting induced precession. Thus, tong assembly 10 provides a secure mounting system for tong 11 that is capable of withstanding the rigors and vibrations of tong operation.

For the purpose of allowing tightening and installation of lug nuts 82, frame 16 may be designed to afford a user access to the tapered seats 70, which may be defined by tapered washers 71. Access may be required for manually tightening nuts 82, for example with a power tool or a ratchet. Tong 11, which may be a power tong 14 as shown, is mounted above the horizontally extending support surface 66 in FIG. 6, and access to lug nuts 82 may be below the tong 11 as shown, along path 88. Vertical tubular extensions 90 from the frame 16 may form horizontally extending surface 66 and may be used to space the tong 11 a vertical distance from the frame 16, to give sufficient room for the lower or upper profile of the tong 11 to fit on frame 16. Other shapes of extensions 90 may be used for this purpose. Because many power tongs 14 already have numerous rods 74 that extend beyond a lower or upper cage plate 92 or 94, respectively, terminating in one or more nuts 96 for example, and potentially forming suitable mounting points for lug nuts 82, extensions 90 may be advantageously used to retrofit an existing frame 16 to accommodate a tong 11 with such rods 74, irrespective of the spatial arrangement of the rods 74 across the lower or upper cage plate.

Referring to FIGS. 1 and 6, the tong 11 is secured to the frame 16 by four or more respective threaded pins 72, each extended through respective ones of the tapered seats 70 (FIG. 6). Although only 3 pins 72 are illustrated in FIGS. 1 and 6 in combination, it should be understood that tong 11 has a plane 98 (FIG. 6) of pin symmetry, and thus the location of the fourth pin 72 is discernable from the drawings. Other numbers of pins 72 may be used as is suitable.

Figure 10:
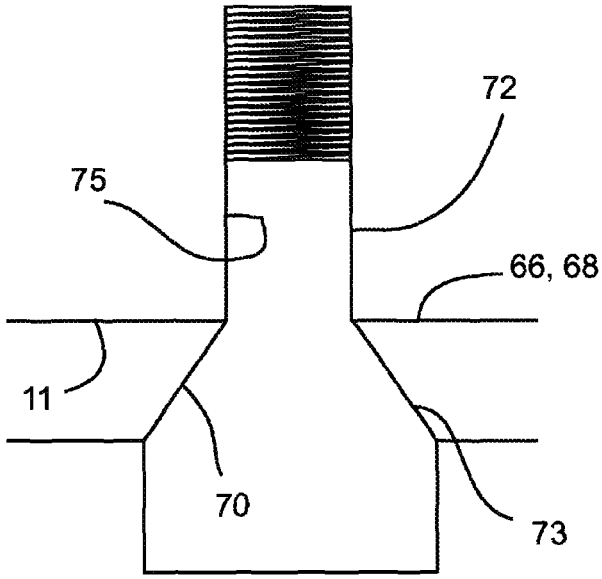
FIG. 10 is a side elevation section view of a lug bolt threaded into the power tong and seated on a tapered seat of a frame element.

Referring to FIG. 6, in the example shown the lugs comprise lug nuts 82 threaded on threaded pins 72. Referring to FIG. 10, one or more lug and respective threaded pin 72 may in combination form a lug bolt 73. Lug bolt 73 may seat against tapered seat 70, and may thread into a corresponding threaded hole 75 in tong 11.

Although the tong 11 is shown as a power tong 14, tong 11 may also be a backup tong 12. In addition, although tong 11 is shown mounted above frame 16, this orientation may be reversed so tong 11 is mounted below frame 16. A backup tong 12 may be mounted on the frame 16 in combination with power tong 14 (FIG. 1).

Figure 7:
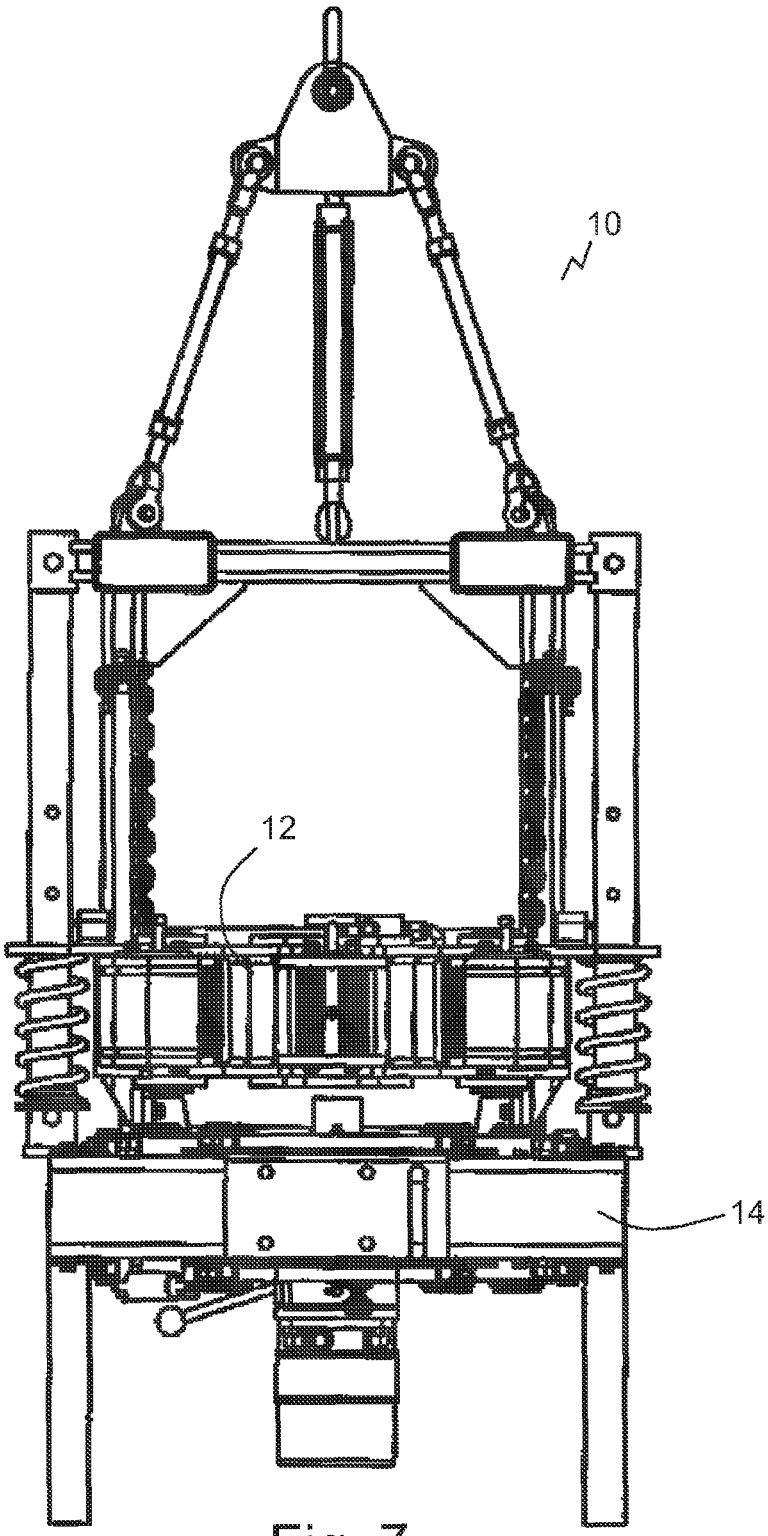
FIGS. 7 and 8 illustrate front elevation and side elevation views, respectively, of a reverse tong arrangement with the backup tong positioned above the power tong.
Figure 8:
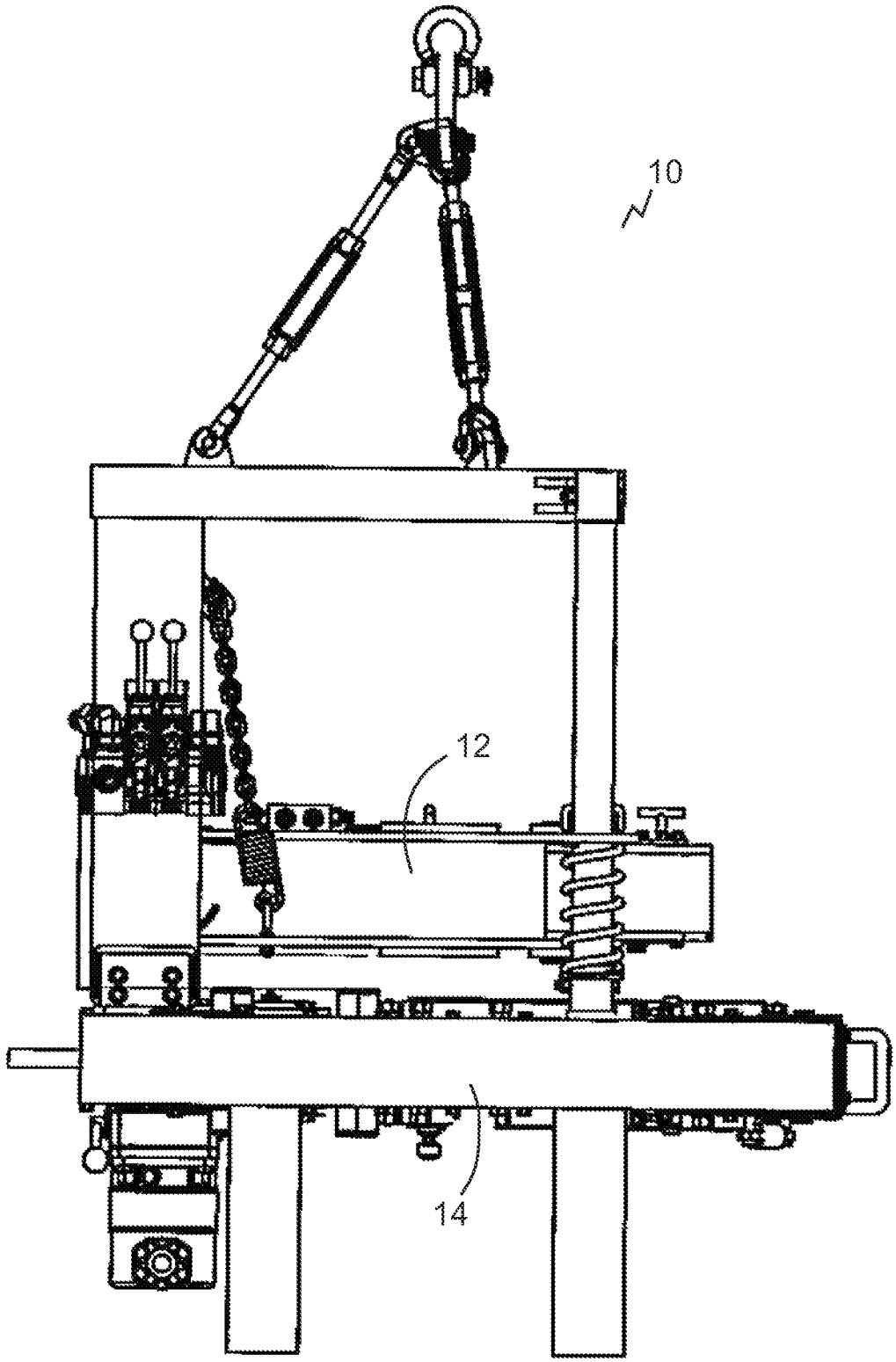

Referring to FIGS. 7 and 8, as disclosed above, a reverse arrangement of backup tong 12 and power tong 14 may be used, with the backup tong 12 positioned above the power tong 14. Such an arrangement may be advantageous in a variety of applications, including use in a coker unit in some refineries and for coiled tubing. In the reverse arrangement the bottom tubular (not shown) is rotated while the top tubular remains stationary during joint makeup and breakout. This arrangement is advantageous over the use of manual equipment to make up and breakout joints in situations where the upper tubular (not shown) must be held stationary or the lower tubular (not shown) must be rotated.

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A tong assembly, comprising:

a frame having at least a pair of posts spaced laterally from each other to receive a tong between the posts, each post extending vertically and having a lateral stabilizing surface on a side facing inward or outward; and a tong stabilized in relation to the frame by the lateral stabilizing surfaces and by each post being received by respective openings in the tong that have a cross lateral dimension sufficient to permit cross lateral movement of the tong in relation to the frame by at least one half of the cross lateral length of the lateral stabilizing surface.

2. The tong assembly of claim 1 in which the lateral stabilizing surfaces both face inward.

3. The tong assembly of claim 1 in which the tong comprises a backup tong.

4. The tong assembly of claim 3 further comprising a power tong mounted on the frame.

5. The tong assembly of claim 4 in which the backup tong is located below or above the power tong.

6. The tong assembly of claim 1 in which the cross lateral dimensions are sufficient to permit cross lateral movement of the tong in relation to the frame by at least the cross lateral length of the lateral stabilizing surface.

7. The tong assembly of claim 1 in which the pair of posts form suspension struts for the tong.

8. The tong assembly of claim 1 in which the tong has a pair of guide rollers between the lateral stabilizing surfaces.

9. The tong assembly of claim 1 in which each posts has a truncated circle or truncated ellipse cross sectional.

10. A tong assembly, comprising:

a frame having at least a horizontally extending support surface defined by one or more frame elements, the one or more frame elements including tapered seats that widen vertically;

a tong mounted on the frame and secured to the frame by respective threaded pins that are secured to the tong and extend through the horizontally extending support surface and through respective ones of the tapered seats; and a lug on each threaded pin, each lug having a taper matching the taper of the corresponding tapered seat to seat the threaded pin centered in the tapered seat when the lug is tightened.

11. The tong assembly of claim 10 in which one or more lug comprises a lug nut threaded on the threaded pin.

12. The tong assembly of claim 10 in which one or more lug and respective threaded pin in combination form a lug bolt.

13. The tong assembly of claim 10 in which the tong is a power tong.

14. The tong assembly of claim 13 further comprising a backup tong mounted on the frame.

15. The tong assembly of claim 10 in which one or more of the tapered seats are defined by a tapered washer.

16. The tong assembly of claim 10 in which the threaded pin defines an axis of rotation of a component within the tong.

17. The tong assembly of claim 10 in which one or more of the tapered seats are within vertical tubular extensions from the frame.

18. The tong assembly of claim 10 in which the tong is mounted above the horizontally extending support surface.

19. The tong assembly of claim 10 in which the tong is secured to the frame by four or more respective threaded pins that are secured to the tong and extend through the horizontally extending support surface and through respective ones of the tapered seats.

* * * * *